US008261766B1

(12) United States Patent
Huang

(10) Patent No.: US 8,261,766 B1
(45) Date of Patent: Sep. 11, 2012

(54) POSITIONING STRUCTURE FOR ASSEMBLY OF A WATER FAUCET PLAQUETTE

(75) Inventor: Shao-Ting Huang, Changhua (TW)

(73) Assignee: Crescent Plumbing, Inc., Shianshi Shang, Changhua (TW)

( * ) Notice: Subject to any disclaimer, the term of this patent is extended or adjusted under 35 U.S.C. 154(b) by 388 days.

(21) Appl. No.: 12/605,345

(22) Filed: Oct. 25, 2009

(51) Int. Cl.
*F16L 5/00* (2006.01)

(52) U.S. Cl. ..... 137/359; 137/360

(58) Field of Classification Search ..... 137/359, 137/360; 285/46, 64; 4/675
See application file for complete search history.

(56) References Cited

U.S. PATENT DOCUMENTS 3,823,964 A * 7/1974 Politz ..... 285/46
3,960,016 A * 6/1976 Symmons ..... 374/148
4,215,751 A * 8/1980 Mears ..... 169/51
4,385,777 A * 5/1983 Logsdon ..... 285/12
4,562,964 A * 1/1986 Diamond ..... 239/288.5
4,960,628 A * 10/1990 Stumphauzer et al. ..... 428/81
5,236,229 A * 8/1993 Gonzalez ..... 285/46
5,277,220 A * 1/1994 Thul ..... 137/359
5,755,463 A * 5/1998 Davidson ..... 285/46
5,947,147 A * 9/1999 Gnauert et al. ..... 137/218
6,178,993 B1 * 1/2001 Oberdorfer ..... 137/359
6,419,276 B1 * 7/2002 Gatter et al. ..... 285/46
6,726,161 B2 * 4/2004 Plump et al. ..... 248/205.1

* cited by examiner

*Primary Examiner* — Craig Schneider
*Assistant Examiner* — Kevin Murphy
(74) *Attorney, Agent, or Firm* — Egbert Law Offices, PLLC

(57) ABSTRACT

A positioning structure for assembly of the water faucet plaquette has a plaquette having front face, a depressed back and a through-hole. The depressed back of the plaquette has a bent positioning claw. A wall permanent seat has a plaquette assembly surface, an abutting surface and a fixed portion. The fixed portion is positioned fixedly onto the wall. The plaquette assembly surface of the wall permanent seat is fitted with limit surfaces, which are aligned transversely with the positioning claw. A soft liner ring is fitted with at least two slots that are fitted onto the positioning claws. The limit surface has a pair of tabs and a vertical lug engaged with the position claw.

6 Claims, 7 Drawing Sheets

POSITIONING STRUCTURE FOR ASSEMBLY OF A WATER FAUCET PLAQUETTE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a positioning structure for assembly of the water faucet plaquette, and more particularly to an innovative structure, which allows for easy and rapid assembly with improved aesthetic effects and attractiveness.

2. Description of Related Art Including Information Disclosed Under 37 CFR 1.97 and 37 CFR 1.98

A variety of water faucet products have been developed in response to the diversified customer requirements with the growing living standards.

The inventor intends to improve the positioning structure of the water faucet plaquette. The water faucet plaquette is generally incorporated into a wall-mounted water faucet switch, so that a sense of depth and decorative effect are formed between the water faucet and the wall. However, the typical water faucet plaquette is structurally designed in such a manner that it is mainly screwed by threads or bolts, making it convenient for removal and assembly. Moreover, since the fixed screwing angle and orientation make it difficult for accurate molding, the plaquette is only limited to round shapes rather than square and rectangular shapes. Also, the exposure of bolts will reduce the overall aesthetic appearance and attractiveness of the plaquette.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

Based on the unique positioning structure of a water faucet plaquette of the present invention, a plaquette is fitted with positioning claws, and the wall permanent seat is fitted with limit discs. Compared with prior art, the assembly state of the wall permanent seat and the plaquette can be positioned securely by mating of the positioning claws and the limit discs, thus realizing rapid and easy assembly with improved overall aesthetic effect and attractiveness of the plaquette. On the other hand, as the plaquette is fitted with at least two positioning claws, the users are allowed to adjust freely the preset angle in line with different patterns of the plaquette, so that the plaquette with angular variations can meet the diversified user demands for improved applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
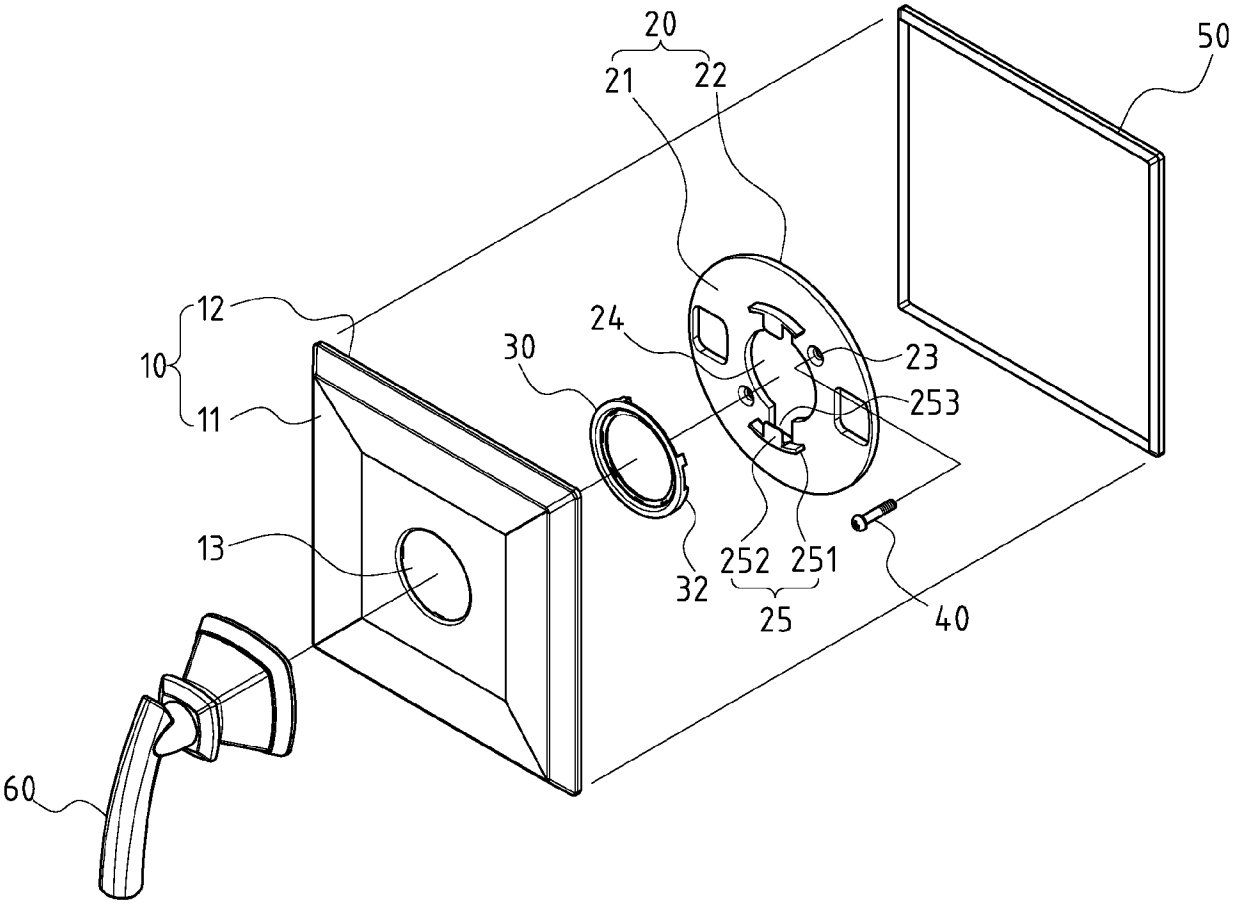
FIG. 1 is an exploded perspective view of the preferred embodiment of the present invention.
Figure 2:
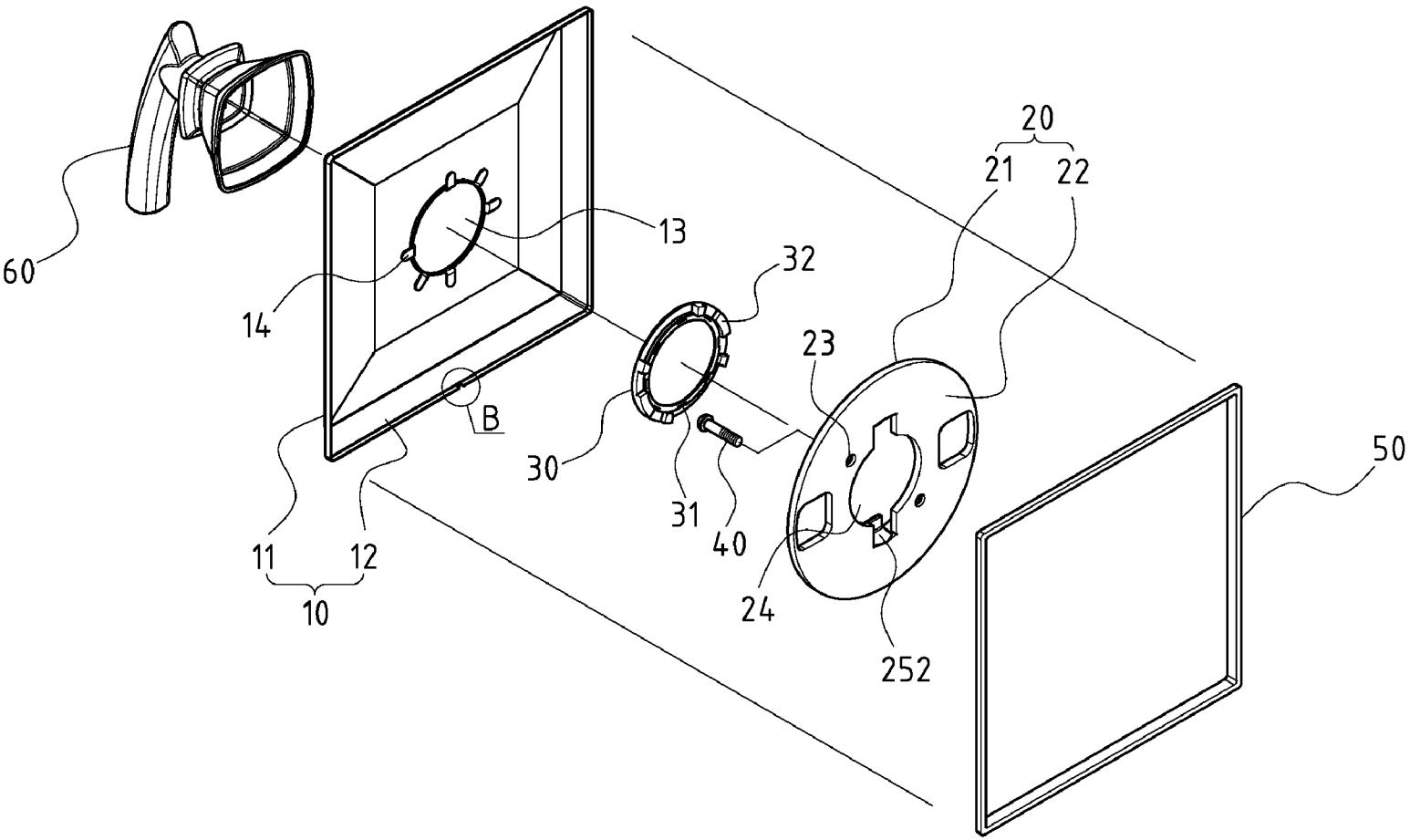
FIG. 2 is an exploded perspective view of the preferred embodiment of the present invention viewed from another angle.

FIGS. 1-2 depict preferred embodiments of a positioning structure of a water faucet plaquette of the present invention. The embodiments are provided for only explanatory objectives with respect to the patent claims.

The positioning structure for assembly of the water faucet plaquette, comprises a plaquette 10, which is a cover plate defining a front face 11 and a depressed back 12. A through-hole 13 is opened at the center of the plaquette 10. A handle 60 is installed onto the front face 11 of the plaquette 10, whilst a pipeline can be mounted into the through-hole 13 to form a water faucet. The handle 60 is used to control the water flow and flow rate of the water faucet.

The positioning structure also includes at least two positioning claws 14, which are set separately onto the periphery of the through-hole 13 corresponding to the depressed back 12 of the plaquette 10.

The positioning structure also includes a wall permanent seat 20, including a plaquette assembly surface 21, an abutting surface 22 and a fixed portion 23. The fixed portion 23 is set securely onto the wall surface, and a punch hole 24 is set on the wall permanent seat 20 corresponding to the through-hole 13 of the plaquette 10.

The positioning structure also includes two limit tabs 25 are arranged at intervals on the plaquette assembly surface 21 of the wall permanent seat 20 close to the punch hole 24. The limit tabs 25 are placed transversely in relation to the positioning claws 14.

A soft liner ring 30 in a hollow state comprises at least two slots 31 that are placed onto the positioning claws 14, enabling the limited assembly of the soft liner ring 30 and the plaquette 10. The soft liner ring 30 is made of plastic or rubber materials.

Figure 4:
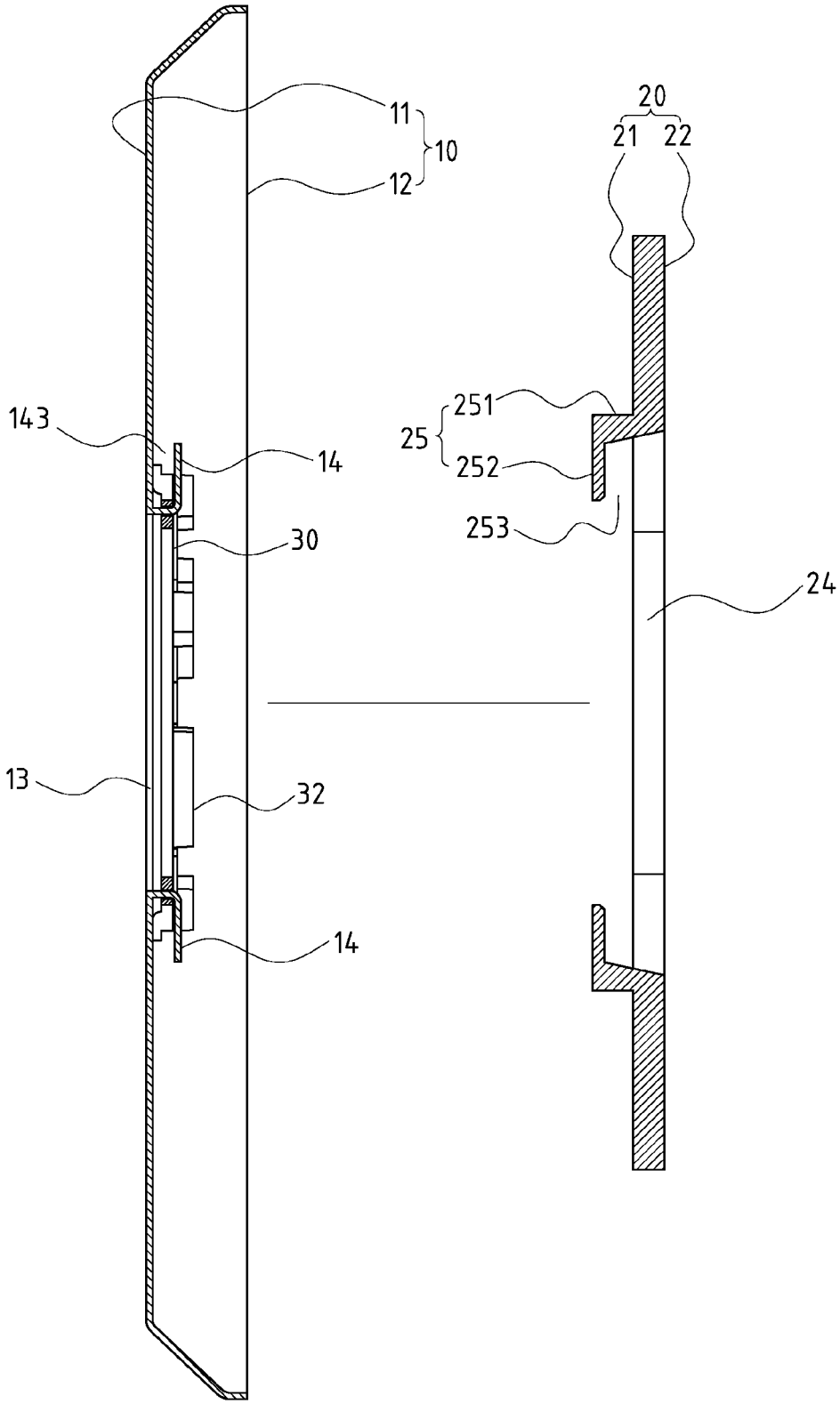
FIG. 4 is an exploded sectional view of the preferred embodiment of the present invention.

The limit tab 25 includes a transverse blocking tab 251 and a vertical lug 252. The vertical lug 252 is formed by bending of one side of the transverse blocking tab 251, and a penetrating port 253 is defined. The penetrating port 253 of two limit tabs 25 is arranged inwards, while the positioning claw 14 is bended to define an assembly port 143 (depicted in FIG. 4) that is arranged outwards.

A plurality of protruding flanges 32 is formed at interval onto the wall of the soft liner ring 30. When the positioning claw 14 is aligned with the limit tab 25, the protruding flanges 32 of the soft liner ring 30 can block off the positioning claw 14, allowing to fix the assembly of the plaquette 10 in a limited rotation state.

The fixed portion 23 is of at least two tapped holes, which are screwed via the bolt 40 into the wall permanent seat 20 and then bolted onto the wall for assembly purposes.

The depressed back 12 of the plaquette 10 is fitted with a pad 50, which is placed between the plaquette 10 and the wall, thus resulting in an excellent sealing effect between them. When the plaquette 10 is to be mounted onto the wall, a satisfactory frictional force can be generated through the pad 50, so that the plaquette 10 can be easily assembled onto the wall (in collaboration with FIGS. 1, 2).

Figure 7:
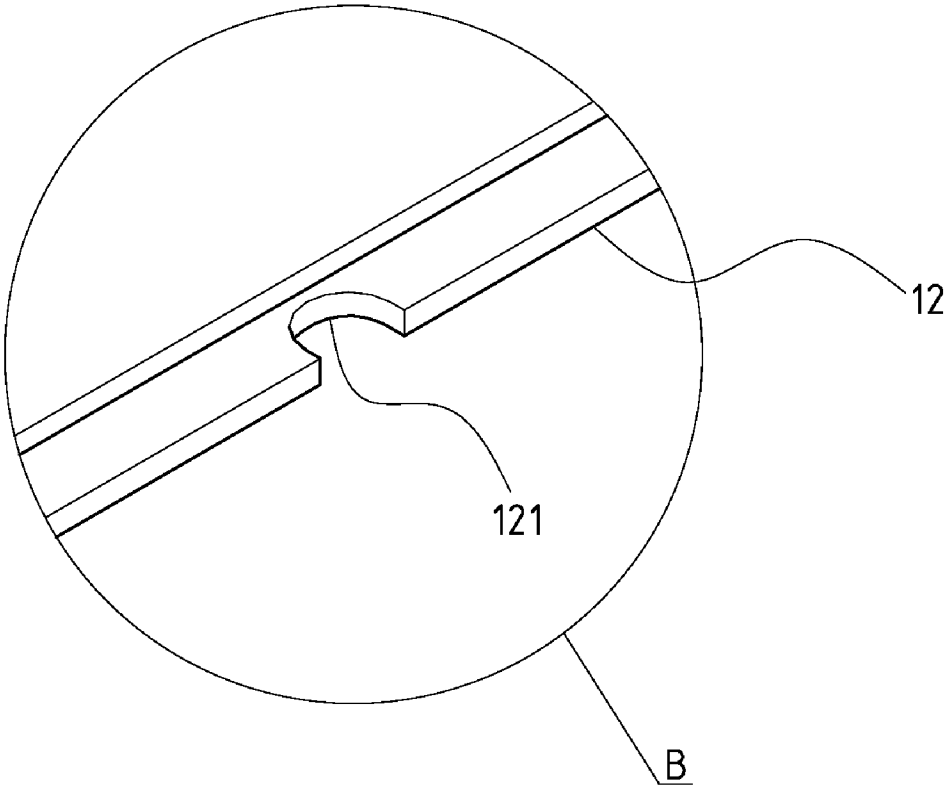
FIG. 7 is an enlarged perspective view of FIG. 2 at reference letter B.

Referring to FIG. 7, a depressed hole 121 is set at one side of the depressed back 12 of the plaquette 10. When the plaquette 10 is mounted onto the wall, the liquid accumulated in the plaquette 10 can be discharged from the depressed hole 121 of the plaquette 10 to avoid rustiness due to internal moisture.

Figure 3:
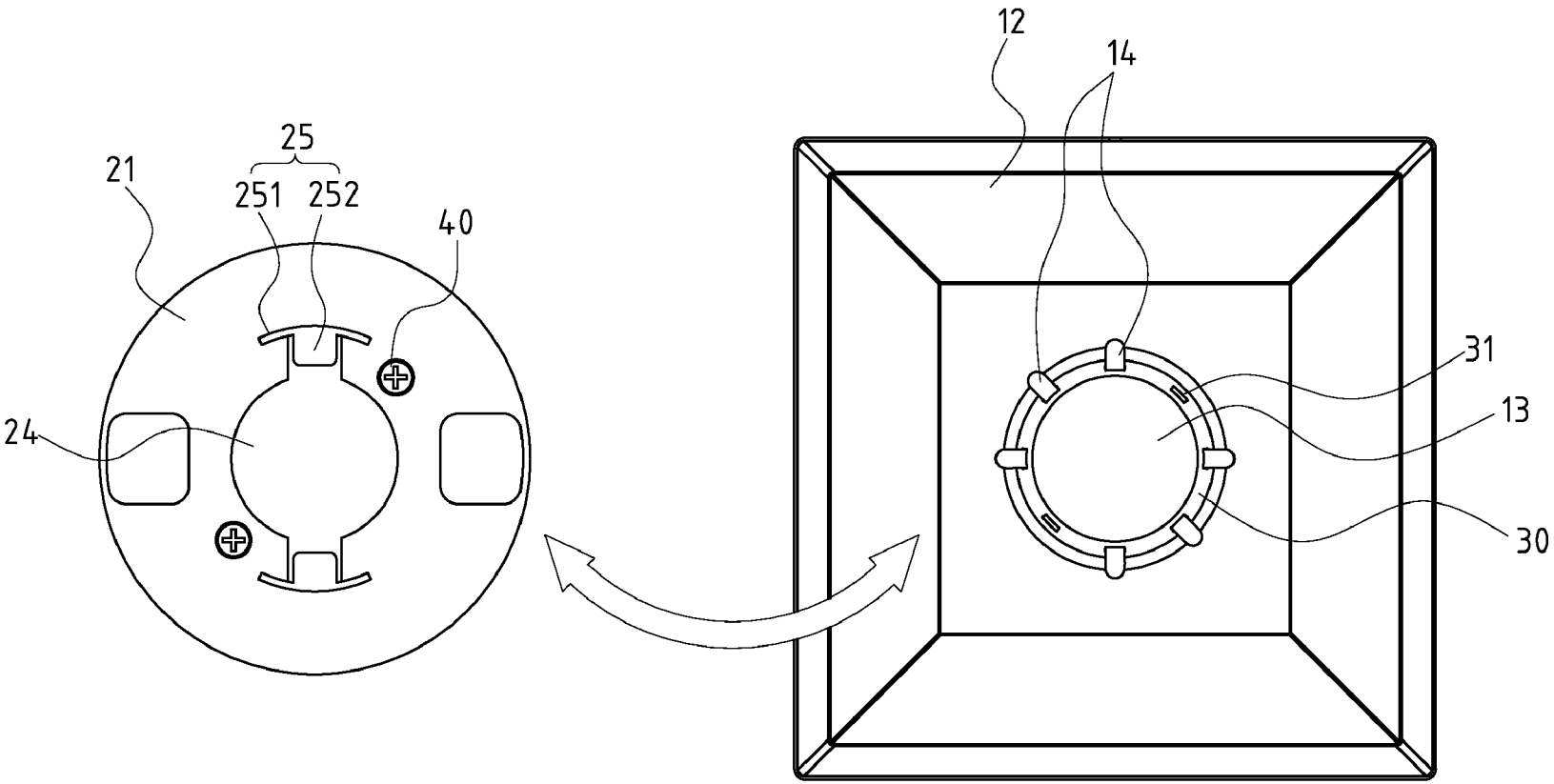
FIG. 3 is an elevation view of the assembly of the preferred embodiment of the present invention.

Based upon above-specified structures, the present invention is operated as follows:

Referring to FIGS. 2 and 3, the abutting surface 22 of the wall permanent seat 20 is first placed correspondingly to the wall, and then screwed onto the wall via the bolt 40. In such a case, the plaquette assembly surface 21 is placed outwards. Next, the slot 31 of the soft liner ring 30 is aligned with the positioning claw 14 of the plaquette 10 and then fitted onto it, so that the soft liner ring 30 is assembled onto the plaquette 10 (in collaboration with FIG. 4).

Figure 5:
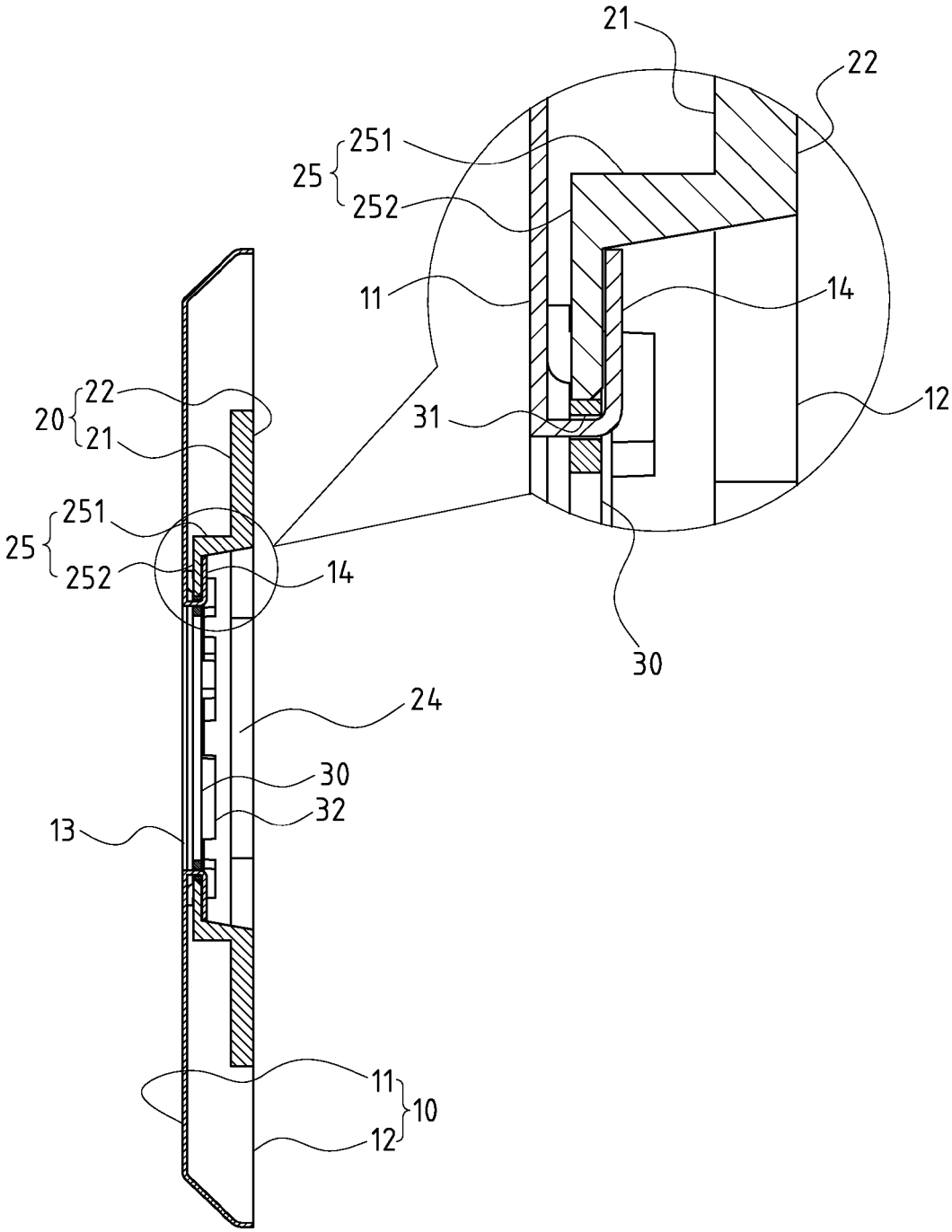
FIG. 5 is an assembled sectional view of the preferred embodiment of the present invention.
Figure 6:
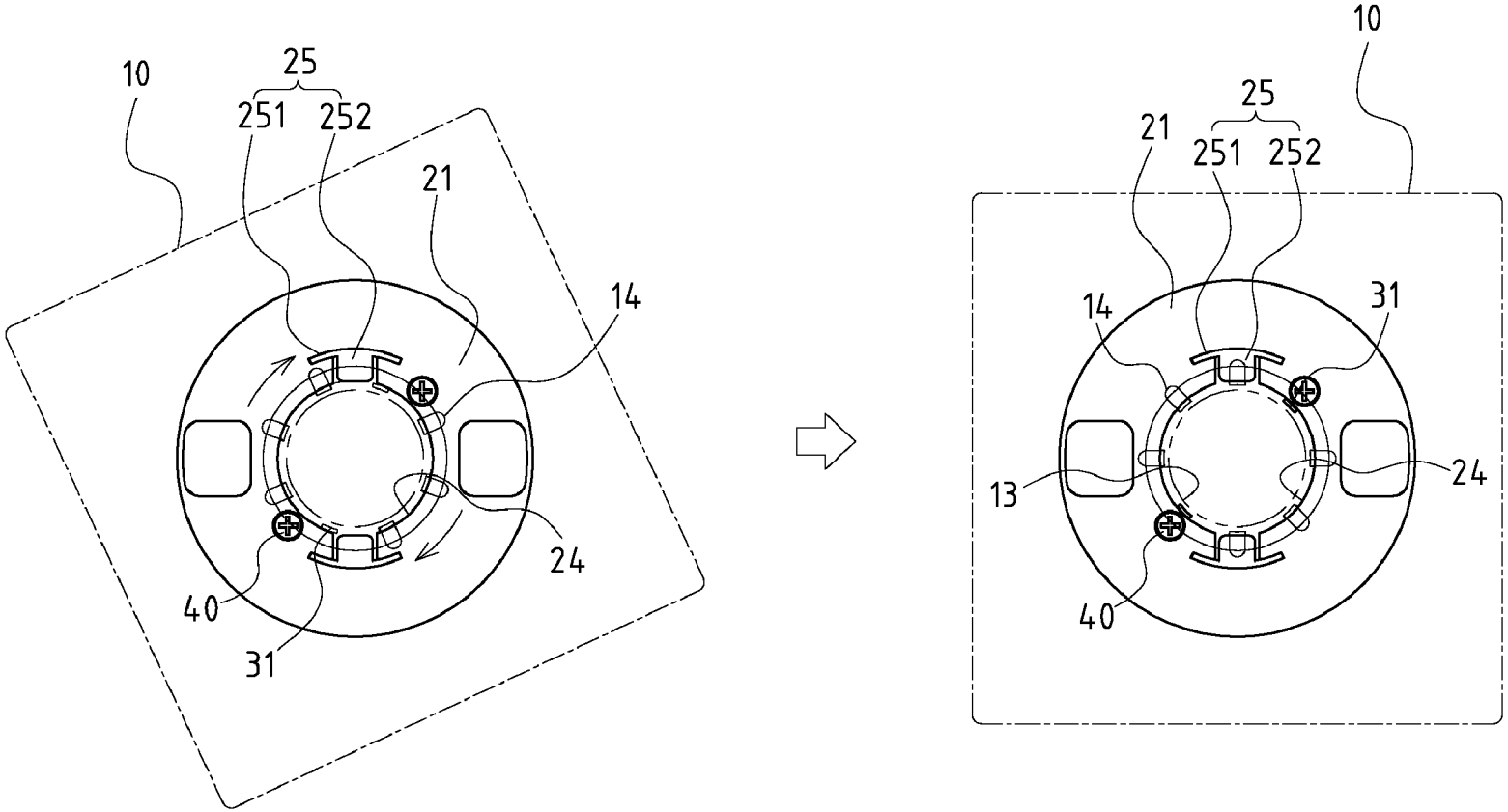
FIG. 6 is a schematic view of the actuating of the preferred embodiment of the present invention.

Referring also to FIG. 6, when the plaquette 10 is mounted securely onto the wall permanent seat 20, the plaquette 10 is rotated to an angle disclosed in left view of FIG. 6), and the penetrating port 253 of the limit surface 25 is aligned with the assembly port 143 of the positioning claw 14. Next, the plaquette 10 is rotated such that the vertical lug 252 of the limit surface 25 is aligned transversely with the positioning claw 14 (shown in FIG. 5), allowing the plaquette 10 to rotate to a preset angle and mount the plaquette 10 onto the wall permanent seat 20. The periphery of the plaquette 10 of the present invention is of rectangular shape, permitting to rotate the plaquette 10 into a rectangular shape disclosed in right view of FIG. 6, or rotate the plaquette 10 continuously so that the limit tabs 25 and the other positioning claw 14 are mated at another angle to meet the user demands.

Additionally, the front face 11 of the plaquette 10 of the present invention can be fitted with not only a handle, but also an exhaust pipe, etc, for the same efficacy.

I claim:

1. A positioning assembly for a water faucet, the positioning assembly comprising:

a plaquette defining a front face and a depressed back, said plaquette being a cover plate, said plaquette having a through-hole formed in a center thereof, said through-hole suitable for allowing the water faucet to pass therethrough;

a plurality of positioning claws arranged adjacent to a periphery of said through-hole on said depressed back of said plaquette;

a wall seat having a plaquette assembly surface and an abutting surface, said wall seat having at least one tap hole formed therethrough, said wall seat having a punch hole formed therethrough, said punch hole being aligned with said through-hole of said plaquette, said wall seat having a pair of limit surfaces extending outwardly of said plaquette assembly surface, each of said pair of limit surfaces having a tab extending transverse to a plane of said plaquette assembly surface and residing against an outer edge of at least one of said plurality of positioning claws so as to overlie the positioning claw, each of said pair of limit surfaces having a lug formed between and transverse to said pair of tabs, the lug received in a space between the positioning claw and said depressed back of said plaquette;

at least one fastener respectively received in said at least one tap hole so as to fasten said abutting surface against a wall; and a liner ring formed of a soft material, said liner having a plurality of slots receiving said plurality of positioning claws therein, said liner ring interposed between an edge of said lug and a surface of the positioning claw.

2. The positioning assembly of claim 1, said pair of limit surfaces defining respective penetrating ports at said punch hole.

3. The positioning assembly of claim 1, said liner ring having a plurality of protruding flanges formed in spaced relation thereto.

4. The positioning assembly of claim 1, said at least one tap hole being a pair of tap holes, said at least one fastener being a pair of bolts, each of said pair of bolts respectively received in one of said pair of tap holes.

5. The positioning assembly of claim 1, further comprising:

a pad fitted to said depressed back of said plaquette.

6. The positioning associated of claim 1, said plaquette having a hole formed on one side thereof.

* * * * *